United States Patent [19]

Nishikawa et al.

[11] 4,151,494

[45] Apr. 24, 1979

[54] ELECTRICAL FILTER

[75] Inventors: Toshio Nishikawa, Nagaokakyo; Youhei Ishikawa, Kyoto; Sadahiro Tamura, Kyoto; Sadao Yamashita, Kyoto, all of Japan

[73] Assignee: Murata Manufacturing Co., Ltd., Japan

[21] Appl. No.: 762,187

[22] Filed: Jan. 24, 1977

[30] Foreign Application Priority Data

| | | | |
|---|---|---|---|
| Feb. 10, 1976 | [JP] | Japan | 51-13353 |
| Feb. 10, 1976 | [JP] | Japan | 51-13354 |
| Feb. 10, 1976 | [JP] | Japan | 51-13355 |
| Feb. 10, 1976 | [JP] | Japan | 51-13356 |
| Feb. 10, 1976 | [JP] | Japan | 51-13357 |
| Feb. 10, 1976 | [JP] | Japan | 51-13358 |

[51] Int. Cl.[2] ..... H01P 1/20

[52] U.S. Cl. ..... 333/204; 333/206

[58] Field of Search ..... 333/73 R, 73 C, 73 S, 333/73 W

[56] References Cited

U.S. PATENT DOCUMENTS

| | | | |
|---|---|---|---|
| 2,968,012 | 1/1961 | Alstadter | 333/73 S |
| 3,259,818 | 7/1966 | Garstang et al. | 333/73 C |
| 3,273,083 | 9/1966 | Rose | 333/73 R |
| 3,408,599 | 10/1968 | Horton et al. | 333/73 R |
| 3,505,618 | 4/1970 | McKee | 333/73 R |

*Primary Examiner*—Alfred E. Smith
*Assistant Examiner*—Harry E. Barlow
*Attorney, Agent, or Firm*—Wenderoth, Lind & Ponack

[57] ABSTRACT

The present invention is an electrical filter which includes coaxial resonators, for example, both-end open type 1/2 wave length TEM (transverse electro-magnetic mode) coaxial resonators, each having dielectric material, for example of titanium oxide group, filling the space between an inner conductor and an outer conductor of the resonator for reduction of size and weight of the resonator with optimum quality factor Q and temperature characteristics, while the predetermined number of these coaxial resonators are accommodated in one or more than two bores longitudinally formed in parallel relation to each other in a filter casing of conductive material for coupling the resonators to each other through capacitors.

25 Claims, 19 Drawing Figures

ELECTRICAL FILTER

Figure 1:
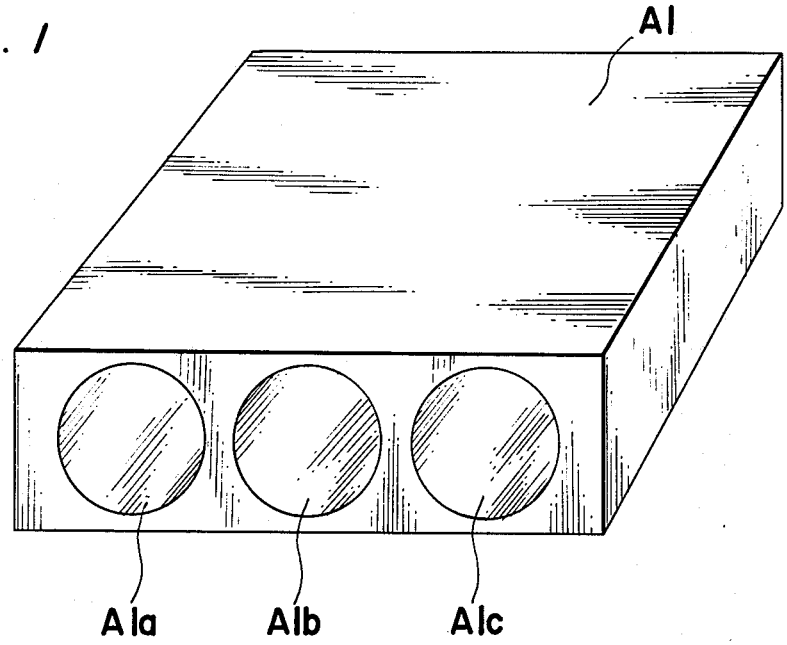

The present invention relates to a filter and more particularly, to an electrical filter employing coaxial resonators, for example, transverse electro-magnetic mode coaxial resonators (referred to as TEM coaxial resonators hereinbelow) for use in electrical and electronic equipment.

In electronic equipment which operates in VHF and UHF ranges, there have been conventionally employed filters utilizing LC resonators or coaxial resonators. The filters of the above described types, however, have disadvantages because sufficient selectivity is not available in the former, while the size of the latter tends to be large.

Recently, in the field of communication equipment in which miniaturization and weight reduction of the systems by reduction of the size and the weight of various components is required, the difficulty in making compact and light weight filters has retarded this miniaturization and reduction in the weight of the systems due to extensive use of filters in the systems because of their importance. Therefore, production of filters of compact size and light weight has been a mandatory goal for engineers in this line of industry to attain by any means.

Meanwhile, another drawback to be encountered in the course of the miniaturization and reduction in weight of the filters is deterioration in quality factor Q, temperature characteristics, and spurious mode response characteristics as well as complication of assembly involved in the manufacture of such filters.

Accordingly, an essential object of the present invention is to provide an electrical filter for use in electrical and electronic equipment which is compact in size and light in weight with substantial elimination of the disadvantages inherent in the conventional filters of this kind.

Another important object of the present invention is to provide an electrical filter of the above described type in which the highest quality factor Q is obtained.

A further object of the present invention is to provide an electrical filter of the above described type which is superior in temperature and spurious mode response characteristics.

A still further object of the present invention is to provide an electrical filter of the above described type which yields performance faithful to the design goals.

Another object of the present invention is to provide an electrical filter of the above described type which can be readily manufactured, with a consequent improvement in productivity and reduction in cost.

A further object of the present invention is to provide an electrical filter of the above described type employing coaxial resonators which are secured and connected to a filter casing in an optimum manner both electrically and mechanically.

According to a preferred embodiment of the present invention, the electrical filter includes coaxial resonators, for example, both-end open type ½ wave length TEM (transverse electro-magnetic mode) coaxial resonators, each having a dielectric material of, for example, the titanium oxide group filled between an inner conductor and an outer conductor of the resonator for reduction of size and weight of the resonator and optimization of the quality factor Q and the temperature characteristics. A predetermined number of these coaxial resonators are fixedly accommodated in one or more than two bores longitudinally formed in parallel relation with each other in a filter casing of conductive material for coupling of the resonators through capacitors. By this arrangement, not only is the assembly of the filter during manufacture facilitated to a large extent, but indefinite factors such as undesirable positional association, coupling capacity or the like between the resonators are eliminated. Thus filters which are faithful in performance to the design goals are advantageously presented.

Figure 2:
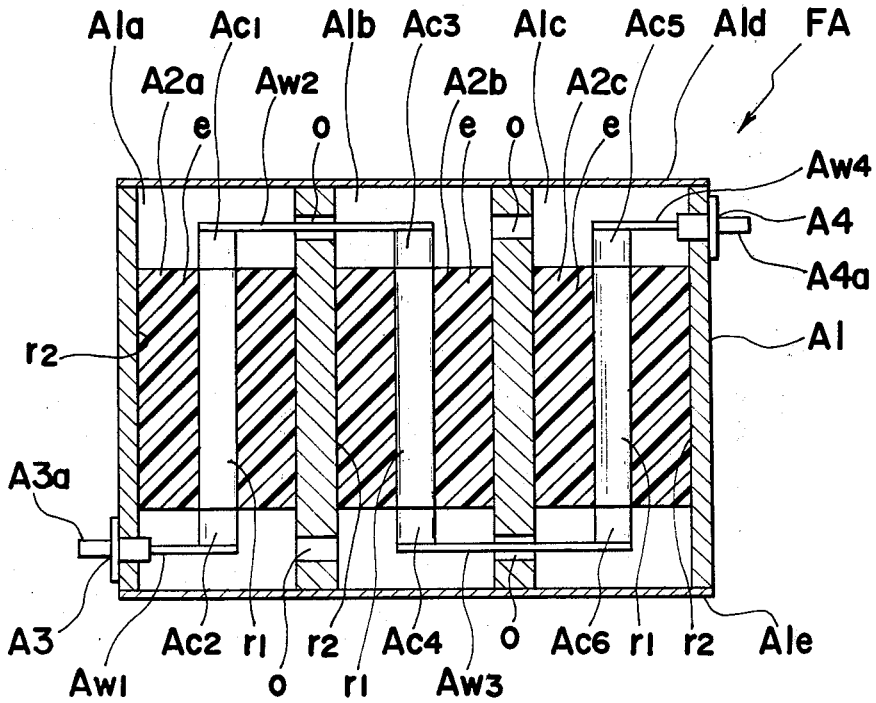
Figure 3:
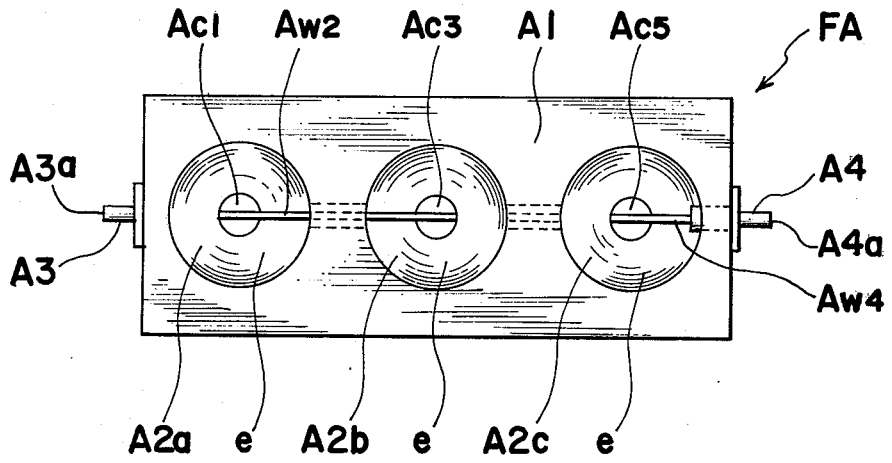
Figure 4:
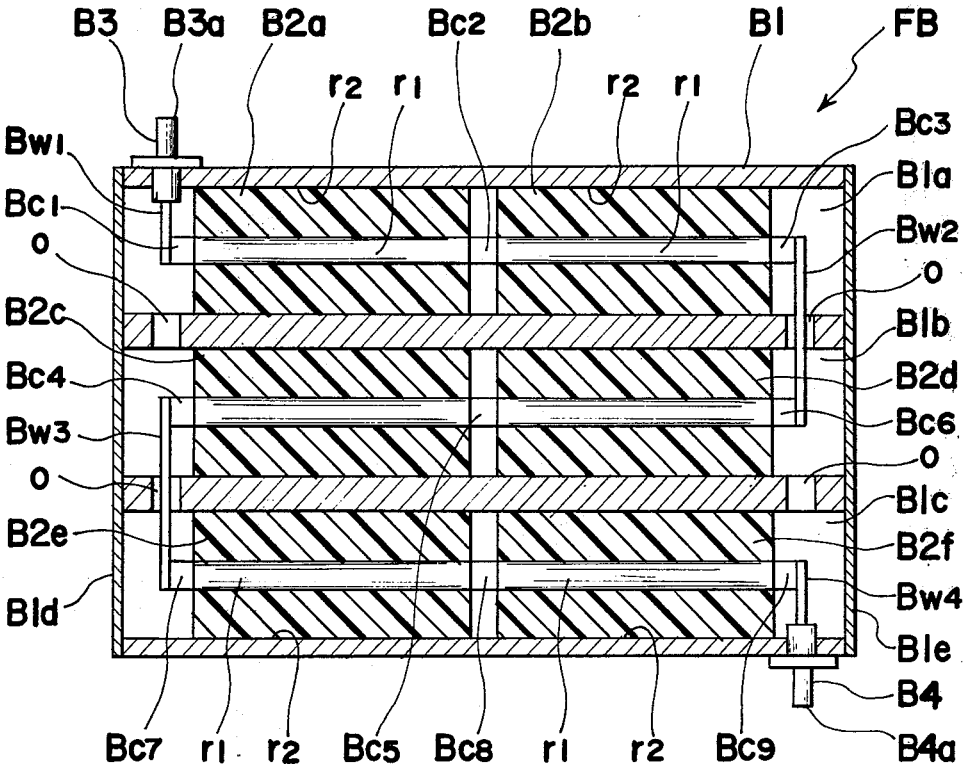
Figure 5:
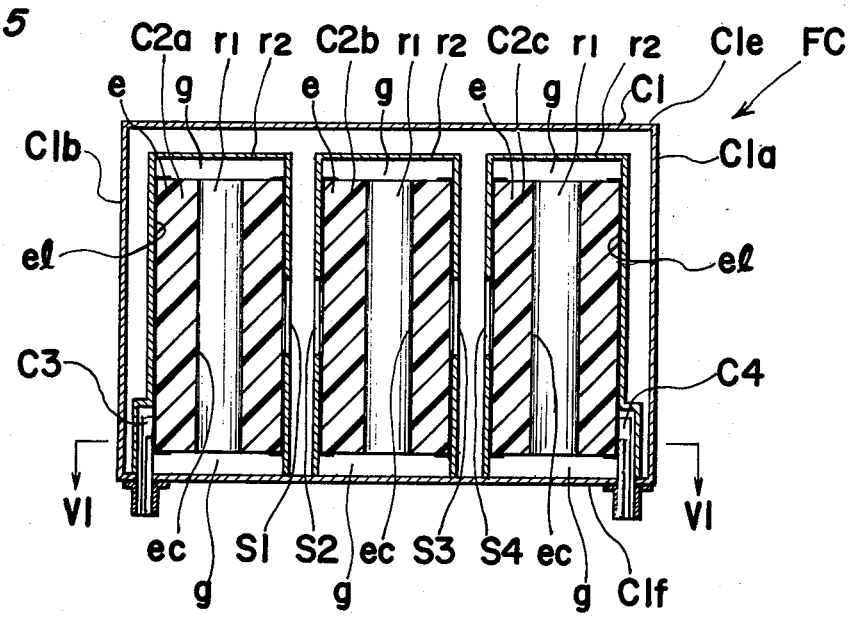
Figure 6:
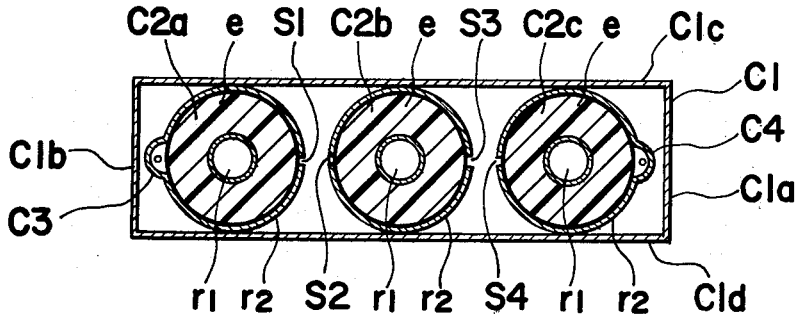
Figure 7:
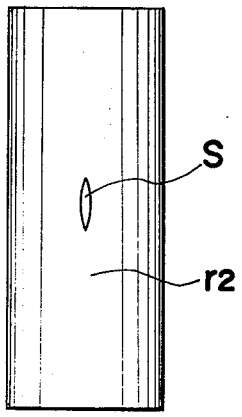
Figure 8:
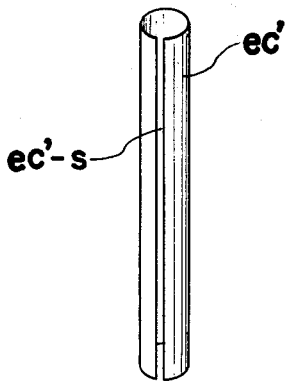
Figure 10:
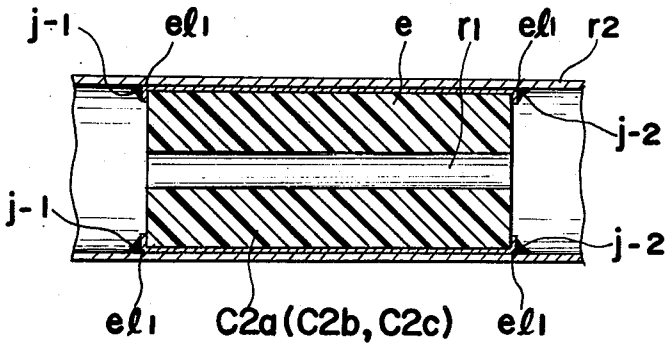
Figure 9:
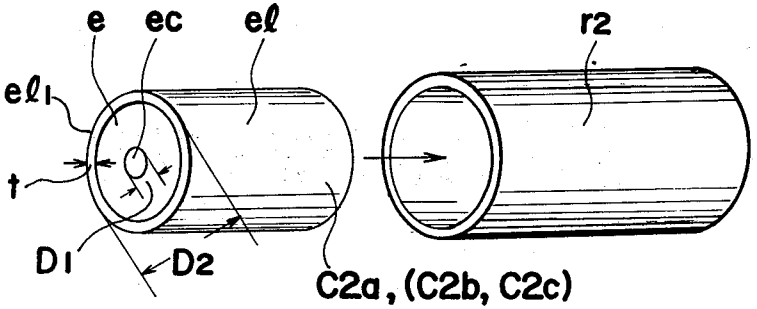
Figure 11:
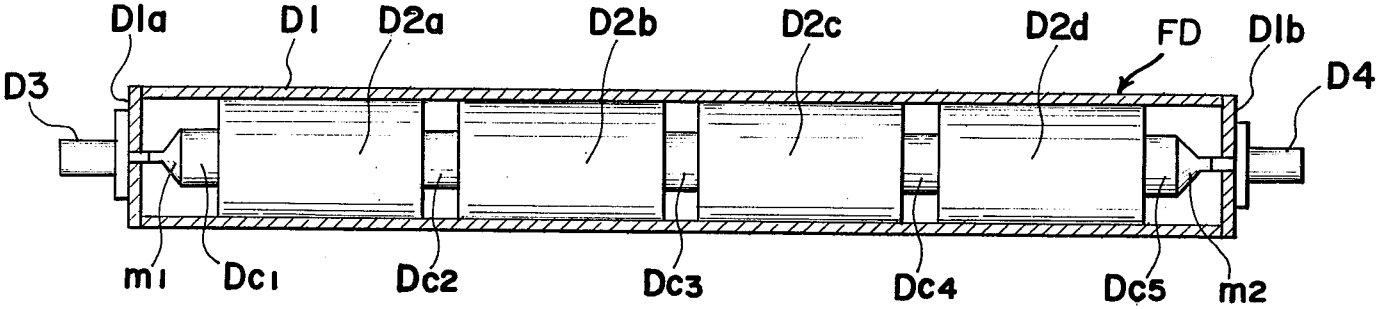
Figure 12:
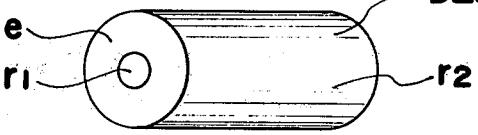
Figure 13:
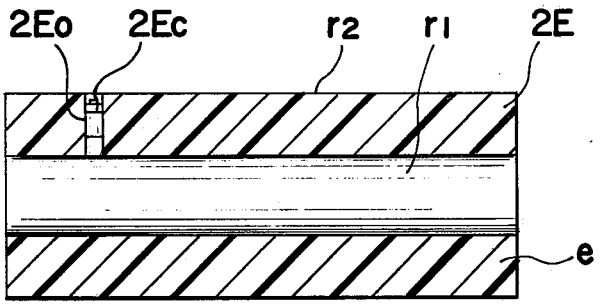
Figure 14:
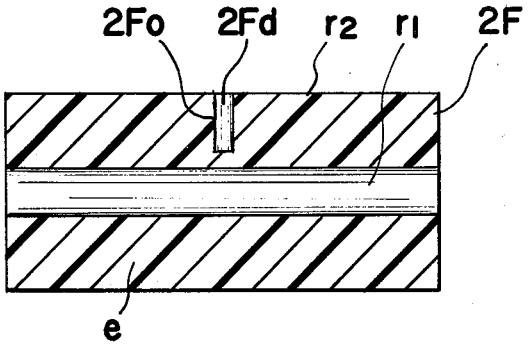
Figure 15:
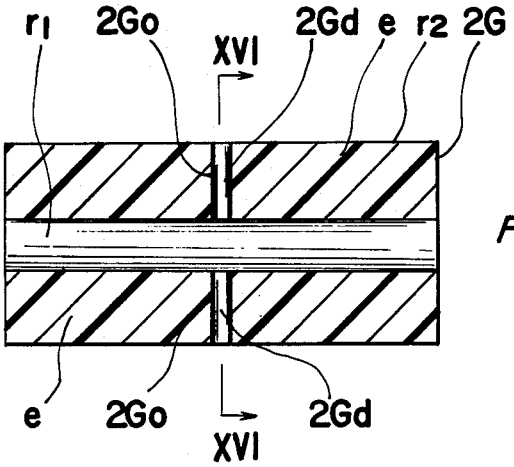
Figure 16:
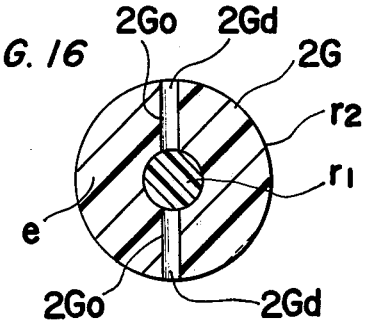
Figure 17:
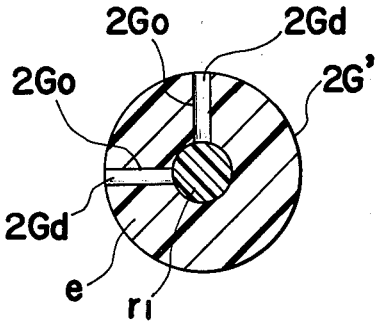
Figure 18:
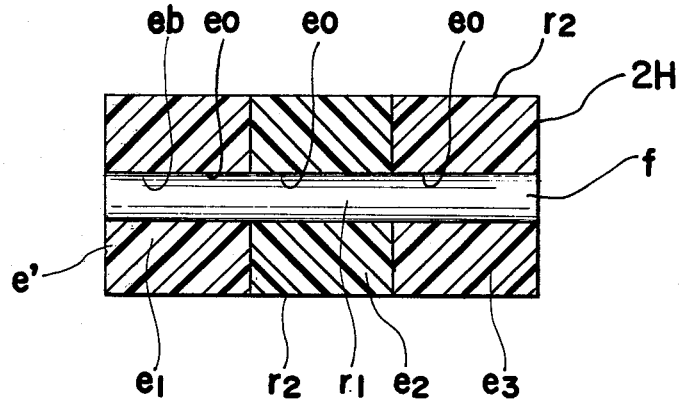
Figure 19:
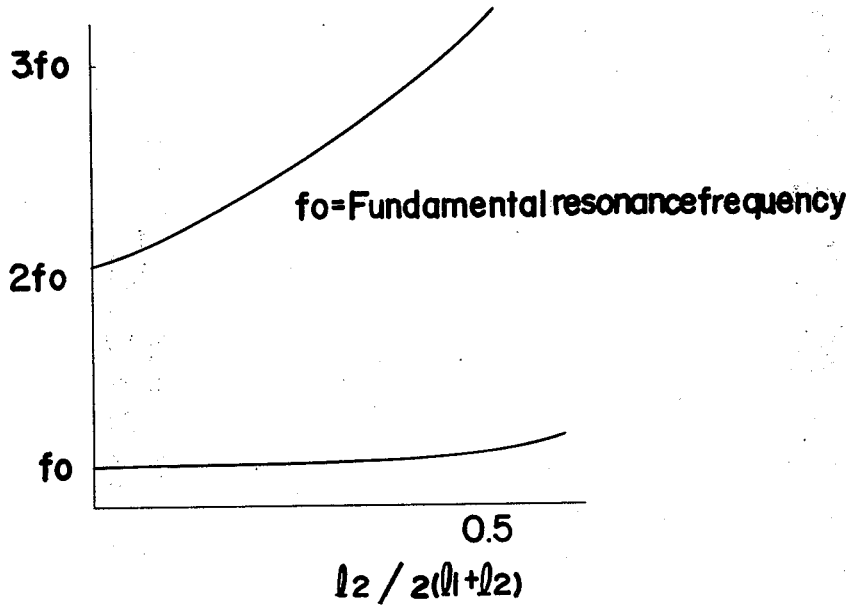

These and other objects and features of the present invention will become apparent from the following description taken in conjunction with the preferred embodiment thereof with reference to the accompanying drawings in which;

FIG. 1 is a perspective view of the casing of an electrical filter according to one embodiment of the present invention, with the coaxial resonators and the cover plate thereof removed for clarity, FIG. 2 is a longitudinal sectional view of the electrical filter accommodating coaxial resonators of the invention in the casing of FIG. 1, FIG. 3 is a front view of the filter of FIG. 2, FIG. 4 is a view similar to FIG. 2, but particularly shows a modification thereof, FIG. 5 is a view similar to FIG. 2, but particularly shows another modification thereof, FIG. 6 is a sectional view taken along the line VI—VI of FIG. 5, FIG. 7 is a side view of an outer conductor employed in the filter of FIG. 5, FIG. 8 is a perspective view showing one example of an inner conductor to be employed in the filter of FIG. 5, FIG. 9 is an exploded view illustrating the construction of the resonator employed in the filter of FIG. 5, FIG. 10 is a sectional view of the resonator of FIG. 9 particularly showing connection between an outer conductor electrode and an outer conductor thereof, FIG. 11 is a longitudinal sectional view which particularly shows a further embodiment of the present invention, FIG. 12 is a perspective view showing the construction of a resonator employed in the filter of FIG. 11, FIG. 13 is a sectional view showing a further modification of the resonators employed in the filter of FIG. 2, FIGS. 14 and 15 are views similar to FIG. 13, but particularly show further modifications thereof, FIG. 16 is a cross sectional view taken along the line XVI—XVI of FIG. 15, FIG. 17 is a view similar to FIG. 16, but particularly shows another modification thereof, FIG. 18 is a view similar to FIG. 13, but particularly shows a still further modification thereof, and FIG. 19 is a graph showing the relation between the fundamental resonance frequency and second higher harmonic frequency in the resonator of FIG. 18.

Before the description of the present invention proceeds, it is to be noted that like parts are designated by like reference numerals throughout the several views of the attached drawings.

Referring now to FIGS. 1 to 3, there is shown a filter FA according to one embodiment of the present invention. The filter FA includes a casing A1 of electrically conductive material, for example, of duralumin having a cubic rectangular configuration and provided with bores A1*a*, A1*b*, and A1*c* longitudinally formed therein in spaced relation to each other as shown in FIG. 1. In these bores A1*a*, A1*b* and A1*c*, there are incorporated both-end open type ½ wave length coaxial TEM resonators A2*a*, A2*b* and A2*c* respectively. Each of the resonators A2*a*, A2*b* and A2*c* includes a cylindrical resonator member e having a coaxially extending bore formed therein and made of a dielectric material, for example of the titanium oxide group. Inner cylindrical conductor r1 is applied on the inner cylindrical surface of the dielectric resonator member e and outer cylindrical conductor r2 is applied to the outer cylindrical surface of the dielectric resonator member e. Each of the cylindrical conductors r1 has its opposed ends electrically connected to corresponding coupling capacitors A*c*1 and A*c*2, A*c*3 and A*c*4 of A*c*5 and A*c*6 through associated electrodes (not shown). Each of the capacitors A*c*1 to A*c*6, may, for example, be formed by a ceramic dielectric material having a diameter approximately equal to that of the inner conductor r1 and provided, for example, with silver electrodes at opposite end faces thereof for connection, at one end face to the electrode of the inner conductor r1. Openings O are formed in the walls of the casing A1 between the bores A1*a* and A1*b*, and A1*b* and A1*c* in positions adjacent to neighboring capacitors A*c*1 to A*c*6, through which wire conductors A*w*2 and A*w*3 are passed to connect the capacitors A*c*1 and A*c*3 for the resonators A2*a* and A2*b* at one side of the casing A1 and the capacitors A*c*4 and A*c*6 of the resonators A2*b* and A2*c* at the other side of the casing A1. The other capacitor A*c*2 of the resonator A2*a* is connected by a wire conductor A*w*1 through the casing A1 to an input coaxial connector A3 mounted at one side of the casing A1 adjacent to the bore A1*a*, while the corresponding capacitor A*c*5 of the resonator A2*c* also connected by a wire conductor A*w*4 through the casing A1 to an output coaxial connector A4 mounted at the other side of the casing A1 adjacent to the bore A1*c*. Upon assembly, the resonators A2*a*, A2*b* and A2*c* are inserted into the corresponding bores A1*a*, A1*b* and A1*c* of the casing A1 respectively and fixed thereto, for example, with electrically conductive adhesive for providing an electrical connection to the casing A1. Alternatively, the resonators A2*a* to A2*c* may be secured in the bores A1*a* to A1*c* with securing screws (not shown). In either case, it is preferable that the outer peripheries of the resonators A2*a* to A2*c* are closely fitted to the inner surfaces of the corresponding bores A1*a* to A1*c*.

More specifically in the above arrangement, the central terminal A3*a* of the output coaxial connector A3 is connected to one end of the inner conductor r1 of the resonator A2*a* through the wire conductor A*w*1 and the capacitor A*c*2, while the other end of the same inner conductor r1 of the resonator A2*a* is connected to one end of the inner conductor r1 of the resonator A2*b* through the capacitor A*c*1, the wire conductor A*w*2 and the capacitor A*c*3. The other end of the inner conductor r1 of the resonator A2*b* is connected to one end of the inner conductor r1 of the resonator A2*c* through the capacitor A*c*4, the wire conductor A*w*3 and the capacitor A*c*6, while the other end of the same inner conductor r1 of the resonator A2*c* is connected to the central terminal A4*a* of the output coaxial connector A4 through the capacitor A*c*5 and the wire conductor A*w*4. On the sides of the casing A1 corresponding to the opposite ends of the bores A1*a*, A1*b* and A1*c*, cover plates A1*d* and A1*e* are secured to the casing A1, for example, by securing screws (not shown) for closing the bores and for perfectly shielding the above described elements housed in the casing A1.

It should be noted here that in the above embodiment, all of the wire conductors A*w*1 to A*w*4 are connected in straight lines to other components such as the capacitors A*c*1 to A*c*6 and the input and output coaxial connectors A3 and A4, with the wire conductors A*w*2 and A*w*3 being connected to the capacitors A*c*1 and A*c*3, and A*c*4 to A*c*6 through the openings O respectively. This arrangement is particularly effective for eliminating quality irregularities during manufacture, thus providing products in precise compliance with the intended performance.

In the connections as described above, the electrodes of the capacitors A*c*1 to A*c*6 may either be soldered, bonded with electrically conductive adhesive, or welded to the corresponding electrodes formed at the end portions of the inner conductors r1. Similarly, the wire conductors A*w*1 to A*w*4 may either be soldered, bonded with electrically conductive adhesive, or welded to the corresponding electrodes of the capacitors A*c*1 to A*c*6.

It should also be noted that the construction of the capacitors A*c*1 to A*c*6 connected at their electrodes to respective end portions of the inner conductors r1 not only makes it easy to analytically calculate the coupling coefficient of these capacitors, with consequent facilitation in designing of the filter, but provides the smallest loss in quality factor Q.

Referring now to FIG. 4, there is shown a modification of the filter FA of FIGS. 1 to 3. In this modified filter FB, the casing A1 employed in the embodiment of FIGS. 1 to 3 is replaced by a casing B1 of similar material having a length larger than that of casing A1 and having bores B1*a*, B1*b*, and B1*c* longitudinally extending through the casing B1 in a manner similar to the openings A1*a* to A1*c* of FIGS. 1 to 3. The both-end open type ½ wave length coaxial TEM resonators B2*a* and B2*b*, B2*c* and B2*d*, and B2*e* and B2*f* which are connected in series at corresponding ends of the inner conductors r1 thereof through the respective capacitors B*c*2, B*c*5 and B*c*8 are inserted in the bores B1*a*, B1*b* and B1*c* as shown. The other end of the inner conductor r1 of the resonator B2*a* is connected to the central terminal B3*a* of the input coaxial connector B3 mounted on one side of the casing B1 through the capacitor B*c*1 and the wire conductor B*w*1. The other corresponding ends of the inner conductors r1 of the resonators B2*b* and B2*d* are connected to each other through the capacitors B*c*3 and B*c*6 and the wire conductor B*w*2 which passes in a straight line through an opening O formed in the wall of the casing B1 between the bores B1*a* and B1*b*. The other corresponding ends of the inner conductors r1 of the resonators B2*c* and B2*e* are also connected to each other through the capacitors B*c*4 and B*c*7 and the wire conductor B*w*3 which passes in a straight line through an opening O formed in the wall of the casing B1 between the bores B1*b* and B1*c*. The final end of the resonator B2*f* is connected through the capacitor B*c*9 and the wire conductor B*w*4 to the central terminal B4*a* of the output coaxial connector B4 mounted on the other side of the casing B1 adjacent to the bore B1*c*. The sides of the casing B1 corresponding to the opposite ends of the bores B1*a*, B1*b* and B1*c* are provided with cover plates B1*d* and B1*e* respectively secured to the casing B1 in a manner similar to as in the casing A1 of FIGS. 1 to 3. Other construction features and functions of the filter FB are similar to those of the filter FA of FIGS. 1 to 3 so that detailed description thereof is omitted for brevity.

As is seen from the above description, in the filter according to the present invention, a predetermined number of resonators connected in series with each other may be arranged in a plurality of rows for parallel connection to each other through coupling capacitors, or several rows of such parallel connection of resonators may be provided for further electrical connection with each other depending on the necessity.

Note that the material of the inner and outer conductors is required to have superior high frequency electrical conductivity and also close adhesion to the dielectric member. For this purpose, the inner conductor and outer conductors, especially the outer conductor of the resonator may be formed by applying metal or metal paste superior in high frequency characteristics, for example silver, onto cylindrical ceramic dielectric members e. In the application of this metal onto the cylindrical ceramic dielectric members, various known electrode forming methods, such as coating, deposition, electro-plating, sputtering, flame spraying, ion-plating, electroless plating, etc., may be employed. The outer conductor or inner conductor thus formed on the dielectric member provides the resonators with superior frequency stability with respect to temperature variations, since there is no clearance or gap between the outer or inner conductor and the dielectric member.

Note that these outer and inner conductors may be replaced, according to the principle of the resonator, by corresponding metal tubes or the like applied onto the outer and inner peripheries of the cylindrical dielectric member. In this case, however, not only the external and internal diameters of the cylindrical dielectric member, but the corresponding inner and diameter of the outer conductor and the outer diameter of the inner conductor must be precisely controlled in dimensions to enable the resonators to function at a predetermined frequency, because the resonant frequency of the resonators is determined by these dimensions.

On the contrary, when the metal or metal paste is applied directly onto the cylindrical dielectric member in the earlier described manner by baking, deposition or the like, all that is required is to precisely determine the outer and inner diameters of the cylindrical dielectric member alone, thus contributing greatly to simplification of the manufacturing process of the resonators.

It has been found through a series of experiments carried out by the present inventors that the quality factor Q reaches the highest value when the quotient of the inner diameter of the outer conductor divided by the outer diameter of the inner conductor of the resonator reaches approximately 3.6, and that filters having superior temperature characteristics are obtained if dielectric materials having proper temperature coefficient are selected, since any influence due to the coefficient of the linear expansion of metal conductor can be advantageously cancelled.

As is clear from the foregoing embodiments, according to the filters of the present invention, since the dielectric material fills the coaxial TEM resonators, the filter can be made compact in size, with a consequent reduction in size and weight of the whole communication equipment system, thus contributing to this line of industry to a large extent. Furthermore, the construction of the filter of the invention wherein a predetermined number of coaxial TEM resonators having dielectric material filled between the inner and outer conductors is fixedly in one or more than two bores formed in parallel relation to each other in the casing of conductive material for coupling through capacitors facilitates assembly during manufacture, while indefinite factors such as undesirable positional association, coupling capacity and the like between the resonators are advantageously eliminated. Thus performance in agreement with the intended design is achieved with optimum reproducibility.

Referring now to FIGS. 5 to 10, there is shown another modification of the filter FA of FIGS. 1 to 3. The modified filter FC is particularly designed for achieving favorable securing and connection of the resonators to the filter casing both electrically and mechanically so as to avoid deteriorations in various characteristics due to imperfect electrical connection therebetween. In FIGS. 5 and 6, the filter FC includes a casing C1 of a rectangular hollow box-like configuration defined by side walls C1*a*, C1*b*, C1*c* and C1*d*, and top and bottom walls C1*e* and C1*f*. In this casing C1, a plurality of the both-end open type ½ wave length coaxial TEM resonators, for example three resonators C2*a*, C2*b* and C2*c*, are longitudinally accommodated in spaced and parallel relation to each other as shown. In each of the resonators C2*a*, C2*b* and C2*c*, the dielectric material fills the space between the inner conductor r1 and the outer conductor r2 having a length equal to that of the inner conductor r1. The opposite ends of the outer conductor r2 extend outwardly to a certain extent from the corresponding ends of the inner conductor r1 and the dielectric material e which is flush with the inner conductor r1. One end of the outer conductor r2 is closed, with the other end thereof abutting the bottom wall C1*f* of the casing C1. In the spaces defined between the opposite ends of the inner conductor r1 and the corresponding extreme ends of the outer conductor r2, cut-off waveguides g, which are shortcircuited to the conductors r1 and r2, are formed for constituting the both-end open type resonator and also for suppressing slight radiation loss through the end faces of the dielectric member e. An input exciter line C3 leads out of the casing C1 from between the inner periphery of the outer conductor r2 and the outer periphery of the dielectric member e of the resonator C2*a*. In the modified filter FC, the wire conductors A*w*1 to A*w*4 and the coupling capacitors A*c*1 to A*c*6 described as employed in the filter FA of FIGS. 1 to 3 are dispensed with. Coupling openings S2 and S3 are formed in the outer conductor r2 of the resonator C2*b* near the central portion thereof facing the neighboring resonators C2*a* and C2*c*, while similar coupling openings S1 and S4 are formed in the outer conductors r2 of the resonators C2*a* and C2*c* in positions corresponding to the openings S2 and S3 respectively for magnetic coupling between the resonators C2*a* and C2*b*, and C2*b* and C2*c* as most clearly seen in FIG. 7. An output exciter line C4 leads out of the casing C1 from between the inner periphery of the outer conductor r2 and the outer periphery of the dielectric member e of the resonator C2*c*.

Note here that the configuration of the coupling openings S1 to S4 are preferably such that they will not hinder the flow of electric current passing through the outer conductors r2 for maintaining the quality factor Q and the resonant frequency as stable as possible.

In the production of the filters of above described type, dielectric materials having a hollow cylindrical shape (not shown) are employed as the dielectric members, e, while a central conductor electrode ec for the inner conductor r1 is formed on the inner periphery of the dielectric material e and an outer conductor electrode el is formed on the outer periphery of the dielectric member e, for example, through baking of silver paste thereonto at high temperature. Note that the central conductor electrode ec for the inner conductor r1 described as formed with silver paste in the above embodiment may be replaced by a thin metallic conductor electrode ec' of cylindrical shape having an axial slot ec'-s for elasticity as shown in FIG. 8, and that the inner conductor r1 needs not necessarily be hollow, but some substance, for example, ceramic material f mentioned later with reference to FIG. 18 may fill the inner conductor r1, the important factor affecting the performance of the resonators being the diameter of the inner conductor r1. Note also that the dielectric member e need not be a single unit, but may be a combination of a plurality of components depending on the necessity for manufacturing as also stated with reference to the dielectric member e of the filter FA of FIGS. 1 to 3. One method for fixing the coaxial TEM resonators C2*a* to C2*c*, each having a central conductor electrode ec and an outer conductor electrode el as described above, to the casing C1, is to cause outer conductors r2 of metallic pipe to expand by heating for shrink fit of the resonators C2*a* to C2*c* therein. In this case, since the outer conductors r2 contract as they are cooled, the resonators C2*a* to C2*c* are positively connected and secured to the outer conductors r2 electrically and mechanically. Another method is to fit the resonators C2*a* to C2*c* into the corresponding outer conductors r2, with subsequent filling with electrically conductive paste, solder or the like in the gap therebetween. In either of the above methods, the outer conductors r2 thus secured to the resonators C2*a* to C2*c* are further fixed and connected to the casing C1 both electrically and mechanically by suitable means (not shown).

Note, however, that the former method is rather disadvantageous, resulting in high cost, although ideal from the viewpoint of electrical and mechanical connection between the outer conductors r2 and the resonators C2*a* to C2*c*, while in the latter method, it is difficult to perfectly connect the end portions of the resonators C2*a* to C2*c* and the inner surfaces of the outer conductors r2. Generally, in the resonators of the above described kind, modes of higher order are actually developed to a large extent at the open ends thereof, with evanescent electrical energy being stored outside of these open ends. Therefore, resonance current due to the higher-order mode absent from the TEM approximation values is induced at these open ends. Accordingly, electrical connection between the resonators of the above described kind and the other components, must be perfect to allow the resonance current to flow smoothly from the resonators to these components. Otherwise, various undesirable phenomena such as variations of resonance frequency due to the development of unnecessary inductance, reduction of quality factor Q, unstable resonance frequency with respect to temperatures and the like may result.

In order to eliminate the above described disadvantages, according to the modified filter FC of the invention, junction terminals el1 for connection with the inner surface of the outer conductor r2 may be integrally formed with the outer conductor electrode el along the peripheral edges of side surfaces of each dielectric member e or a peripheral edge of at least one side surface thereof as is mostly clearly seen in FIG. 9. In this case, the width t of the annular junction terminal el1 concentric with the outer conductor electrode el is preferably a value approximate to that obtained by the following equation:

$$t \doteqdot 1/2(D2-D1)\times 0.2$$

where D1 is the internal diameter of the dielectric member e, and D2 is the external diameter of the same dielectric member e.

In the above described construction, after fitting the resonators C2*a* to C2*c*, for example C2*a*, into the corresponding outer conductor r2, the junction terminals el1 are connected to the inner surface of the outer conductor r2, for example, at portions j-1 and j-2 by soldering as shown in FIG. 10. By this arrangement, not only the end portions of the resonators C2*a* to C2*c* are perfectly electrically connected to the inner surfaces of the outer conductors r2, but the resonators C2*a* to C2*c* are mechanically fixed rigidly to the outer conductors r2. In cases where a ¼ wave length resonator one side of which is grounded is employed for further miniaturization of a filter, the junction terminal as described above may be provided only at the other open side of this resonator. In the arrangement described above, the resonators C2*a* to C2*c* may be coupled to each other either magnetically or electrically. In the case of electrical field coupling, shielding plates (not shown) are provided between the respective resonators C2*a* and C2*b*, and C2*b* and C2*c* in FIG. 6, with fixed capacitors or variable capacitors (not shown) being provided to extend through the shielding plates, while the opposite terminals of each of these capacitors are connected to the corresponding ends of the inner conductor r2 of the resonator. Additionally, the resonators C2*a* and C2*c*, and the input connector C3 and output connector C4 may further be modified to be connected by suitable capacitors (not shown), which should preferably be of semi-fixed type of the approximately 0.1 to 3 PF in the case of the above embodiment. Note that in the electric field coupling type, adjustment of the coupling degree is appreciably facilitated. Note further that the method of coupling the input and output to the resonator described as employed in the above embodiments may be replaced by that of the conventional arrangement. Since other construction features and functions of the filter FC of FIGS. 5 to 10 are similar to those of FIGS. 1 to 3, detailed description thereof is omitted for brevity.

As is seen from the foregoing description, according to the modified filter FC of FIGS. 5 to 10, each of the resonators is composed of a hollow cylindrical dielectric member which has a central conductor electrode provided on the inner surface thereof, an outer conductor electrode of silver or other electrode material formed on its outer periphery, and a junction terminal of similar material integral with the outer conductor electrode and formed at the peripheral edge portion of at least one side of the dielectric member. The resonators thus formed are fitted into the corresponding electrically conductive pipes secured to the filter case as the outer conductors and the junction terminals and the inner surfaces of the outer conductors are subsequently connected to each other, for example, by soldering. Accordingly, the resonators are perfectly connected to the filter casing both electrically and mechanically, with consequent elimination of deterioration in various characteristics due to imperfect electrical connections.

Reference is now made to FIGS. 11 and 12 in which there is shown another modification of the filter FA of FIGS. 1 to 3. In this modification having a further object to provide a filter with superior spurious mode characteristics, the filter FD includes a cylindrical casing D1 of electrically conductive material, for example, of duralumin, and a plurality of the both-end open type ½ wave length coaxial TEM resonators, for example, four resonators D2*a* to D2*d* axially housed in this casing D1 in series relation to each other. Each of the resonators D2*a* to D2*d* is of similar construction to that of the resonators A2*a* to A2*c* in the embodiment of FIGS. 1 to 3, so that detailed description thereof is omitted for brevity. At opposite ends of the inner conductor r1 and the dielectric member e of each of the resonators D2*a* to D2*d*, electrodes are provided to form coupling capacitors D*c*1 to D*c*5 through which the resonators D2*a* to D2*d* are coupled to each other. The capacitor D*c*1 at the left-hand end of the resonator D2*a* in FIG. 11 is connected through a matching element m1 to the input coaxial connector D3 mounted on one end plate D1*a* at the corresponding end of the casing D1 for a matched connection between the capacitor D*c*1 and the connector D3. The capacitor D*c*5 at the right-hand end of the resonator D2*d* is coupled through another matching element m2 to the output coaxial connector D4 secured to the other end plate D1*b* at the corresponding end of the casing D1 for a matched connection between the capacitor D*c*5 and the connector D4.

Assembling of the filter FD may be effected, for example, in a manner as described below. The input coaxial connector D3, the matching element m1, the capacitor D*c*1, the resonator D2*a*, the capacitor D*c*2, the resonator D2*b*, the capacitor D*c*3, the resonator D2*c*, the capacitor D*c*4, the resonator D2*d*, the capacitor D*c*5, the matching element m2 and the output coaxial connector D4 are made to contact each other and fixed in that order in the casing D1. The end plates D1*a* and D1*b* at opposite ends of the casing D1 may be screw caps threaded into the corresponding ends of the casing D1, or may be disc members fixed to these ends, for example, by securing screws (not shown), or the connectors D3 and D4 may be provided with portions formed to serve the purpose of end plates D1*a* and D1*b*. Each of the resonators D2*a* to D2*d* is fixed to the inner surface of the casing D1, for example, with electrically conductive adhesive or by securing screws (not shown). In either case, it is preferable that each resonator is accommodated in the casing D1, with the outer periphery of the resonator closely contacting the inner surface of the casing D1 in a manner similar to the filters FA to FC of FIGS. 1 to 10.

The modified filter FD as described above has further advantages and effects in addition to those described with reference to the filter FA of FIGS. 1 to 3 that if the axial direction of the resonator is the Z axis, resonance modes other than those rotationally symmetrical to the Z axis, for example, the $TE_{11}$ mode excited in the filters which use coaxial resonators having the dielectric members are not spurious.

Referring now to FIG. 13, there is shown a modification of the coaxial TEM resonators, for example, the both-end open type coaxial TEM resonators A2*a* to A2*c* described as employed in the filter FA of FIGS. 1 to 3. The modified resonator 2E of FIG. 13 particularly facilitates adjustment of the resonance frequency of the coaxial TEM resonator, and includes a dielectric material, for example the ceramic dielectric member e, of the titanium oxide group filled between the inner conductor r1 and the outer conductor r2 as described in detail with reference to FIGS. 1 to 3, an opening 2E*o* radially extending from the inner conductor r to the outer conductor r2 and formed adjacent to one end of the resonator 2E, and a trimmer capacitor 2E*c* of cylindrical configuration accommodated in the opening 2E*o*, with the stator electrode being connected to the inner conductor r1 and the rotor electrode (not shown) being connected to the outer conductor r2 for example, by soldering. Accordingly, the resonance frequency can be varied advantageously through mere adjustment of the trimmer capacitor 2E*c*. It is to be noted here that the electrodes of the trimmer capacitor 2E*c* should preferably be connected to portions where a strong electric field is present for optimum effect therefrom. In the above described modification, the values for the trimmer capacitor 2E*c* can be obtained from the following formula, $$\tan(\pi \cdot \Delta f / f_0) = \Delta c \cdot \omega \cdot Z_0$$

$$Z_0 = 1/2\pi\sqrt{\mu/\epsilon}\,\log b/a$$

wherein $\Delta f$ is the variable frequency range, $f_0$ is the central frequency, $\Delta c$ is the range in which static capacity of the trimmer capacitor 2E*c* is variable, $Z_0$ is the characteristic impedance, a is the diameter of the inner conductor r1 and b is the diameter of the outer conductor r2.

As is clear from the foregoing description, according to the coaxial resonator 2E of this invention, adjustment of the central frequency of the coaxial TEM resonator having the dielectric member between the inner and outer conductors is facilitated to a large extent by the provision of the variable static capacitor connected between said inner and outer conductors.

Referring to FIG. 14, there is shown another modification of the both-end open type coaxial TEM resonators, for example, resonators A2*a* to A2*c* employed in the filter FA of FIGS. 1 to 3. In the coaxial TEM resonator of the present invention having the dielectric material filling the space between the inner and outer conductors and generally formed as the both-end open type because of its high quality factor Q, there is a tendency that the second harmonic resonance is excited as a spurious mode. The modified both-end open type ½ wave length coaxial TEM resonator 2F of FIG. 14 has as its object to further improve the spurious mode characteristics, and includes the ceramic dielectric material e, for example, of the titanium oxide group filling the space between the inner and outer conductors r1 and r2 in a manner similar to in the resonators A2*a* to A2*c* of FIGS. 1 to 3, an opening 2F*o* extending radially through the dielectric member e from a portion of the dielectric member e spaced to a predetermined distance from the inner conductor r1 to the outer conductor r2 and formed in approximately the central portion of the resonator 2F, and a conductor member 2F*d* having a pipe-like configuration accommodated in the opening 2F*o*.

In the above arrangement, the influence due to the presence of the conductor 2F*d* over the resonance frequency is small, since the electric field of the fundamental wave is zero or close to zero at the center or in the vicinity of the central portion of the resonator 2F. On the other hand, although the electric field of the second higher harmonics is at the maximum value or close to the maximum value at the center or in the vicinity of the central portion of the resonator 2F, the second higher harmonic resonance is not excited, since a series resonance circuit is formed, with respect to the second harmonic, by the conductor 2F*d* and the dielectric member e between the conductor 2F*d* and the inner conductor r1 to shortcircuit the central portion of the resonator 2F. The size of the conductor 2F*d* should properly be selected depending on the purpose, because the frequencies at which the series resonance takes place are determined on the basis of various conditions such as the depth, diameter or the like of the conductor 2F*d*. Even when the series resonance does not occur, the second harmonic resonance occurs at a frequency region deviated from its original position, due to the inductance or capacitance regarded to be connected between the outer conductor r2 and the inner conductor r1 at the central portion of the resonator 2F, and thus the spurious mode characteristics is improved depending on the case.

As is seen from the above description, according to the modified resonator 2F of this invention in which a conductor is housed in an opening formed in the central portion of the both-end open type ½ wave length coaxial TEM resonator including a dielectric member disposed between the inner and outer conductors, either the second harmonic resonance is prevented from occurring or the frequency is shifted to a frequency region without any inconveniences for practical use, with a consequent improvement in the spurious mode characteristics.

In the resonator 2G of FIG. 15 showing a further modification of the resonator 2F of FIG. 14, the opening 2F*o* described as formed in the central portion of the resonator 2F is replaced by a pair of openings 2G*o* each extending radially through the dielectric member e from the inner conductor r1 to the outer conductor r2 along a diametrical line as shown, and conductors 2G*d* having a pipe-like configuration similar to the conductor 2E*d* of FIG. 14 are respectively accommodated in the openings 2G*o* for shortcircuiting the inner conductor r1 and the outer conductor r2. Also in the above modification, since the electric field of the second harmonic is at the maximum value or at values close to the maximum at the center or in the central portion of the resonator 2G and the inner and outer conductors r1 and r2 are in a shortcircuited state or in a state connected through low inductance with respect to the second harmonic resonance at the center or in the central portion of the resonator 2G, the second harmonic resonance is prevented from occurrence or shifted into a high frequency region. Note that the conductors 2G*d* need not necessarily be disposed in the manner as shown in FIGS. 15 and 16, but may be arranged, for example, to radially extend through the dielectric member e at right angles to each other as in the resonator 2G′ shown in FIG. 17, and that the number of the conductors 2G*d* may be increased to any numbers more than two, depending on the necessity. Needless to say that the dimensions of the conductor 2G*d* should be selected to suit to the desired frequency, since the frequency in which the shortcircuited state occurs varies with variations of the diameter of the conductor 2G*d*.

In the resonator 2G of FIGS. 15 to 17 in which the inner conductor r1 and the outer conductor r2 are electrically made conducting at the central portion of the both-end open type ½ wave length coaxial TEM resonator having the dielectric member e between the inner and outer conductors r1 and r2, the second harmonic resonance is either prevented from occurring or moved to a higher frequency region, and thus the spurious mode characteristics are improved.

Referring now to FIGS. 18 and 19, there is shown in FIG. 18 another modification of the resonator 2E of FIG. 13. The modified resonator 2H of FIG. 18 also improves the spurious mode characteristics resulting from the second harmonic resonance in the both-end open type coaxial resonator by reducing the dielectric constant in the central portion thereof to a smaller value than that at other portions of the resonator.

In the modified both-end open type ½ wave length coaxial TEM resonator 2H, the single dielectric member e described as filling the space between the inner and outer conductors r1 and r2 in the resonator 2E of FIG. 13 is replaced by a dielectric member e′ composed of three dielectric members e1, e2 and e3 as shown. The members e1 and e3 disposed adjacent to opposite ends of the resonator 2E are, for example, of ceramic dielectric material of the titanium oxide group, while the central member e2 is, for example, of Vorstellite having a lower dielectric constant than that of the members e1 and e2. In one example of manufacturing the resonator 2H, the dielectric members e1, e2 and e3 each having a central bore eo are bonded to each by suitable means, while silver is baked onto the inner surface of the single central bore eb thus constituted to form the inner conductor r1, with ceramic material f being further filling the central opening eb for reinforcing the resonator as a whole.

Note that, as in the resonators FA to FD and 2E to 2G described with reference to FIGS. 1 to 17, the inner conductor r1 should preferably be filled with ceramic material similar to the ceramic material f for the resonator 2H of FIG. 18. The outer periphery of the dielectric member e′ is baked with silver for the formation of the outer conductor r2 in a manner similar to the resonator 2E of FIG. 13. The central dielectric member e2 should preferably be of ceramic material, since this member e2 must be of material capable of standing the calcinating temperature of silver in the region of from 600° to 900° C., when the inner and outer conductors r1 and r2 are formed of silver for reducing loss. Needless to say, if these inner and outer conductors r1 and r2 are not to be made of calcinated silver, the dielectric member e2 may be of any other material or may be dispensed with.

In the construction as described above, even if the dielectric constant of the dielectric member e2 is small, the influence thereof over the resonance frequency is small, since the electric field of the fundamental wave is at zero or close to zero at the center or in the central portion of the resonator 2H, i.e., within the dielectric member e2, while the electric field of the second harmonic is at the maximum or close to the maximum at the center or in the vicinity of the central portion and thus the effective dielectric constant is remarkably reduced, with consequent large influence over the resonance frequency. That is to say, the resonance of the second harmonic excited as a spurious mode takes place in a still higher frequency range. The resonance frequency of the resonator having the above described construction is given by the following formula:

$$0=2\tan\theta_1+\sqrt{\epsilon 2/\epsilon 1}\tan\theta_2\,(1-\epsilon 2/\epsilon 1\tan^2\theta_1)$$

$$\theta_1=\beta 1 l1,\ \theta_2=\beta 2 l2=\beta 2/\beta 1\cdot l2/l1\cdot\theta_1$$
$$=\sqrt{\epsilon 2/\epsilon 1}\cdot l2/l1\cdot\theta_1$$

wherein $\theta_1$ is the electrical length of the dielectric members e1 and e3, $\theta_2$ is the electrical length of the dielectric member e2, $\beta 1$ is the wavelength constant of the dielectric members e1 and e3, $\beta 2$ is the wavelength constant of the dielectric member e2, l1 is the geometrical length of the dielectric member e2, $\epsilon 1$ is the dielectric constant of the dielectric members e1 and e3, and $\epsilon 2$ is the dielectric constant of the dielectric member e2. In FIG. 19 showing a curve obtained when $l2/2(l1+l2)$ is taken as the abscissa and the frequency as the ordinate according to the above formula, it is clear that the frequency of the second harmonic shows a sharp rise as the length of the dielectric member e2 increases, while the fundamental resonance frequency hardly increases. Additionally, it has been confirmed, through a series of experiments carried out by the present inventors, that the quality factor Q of the resonator in the above case is exactly the same as in the case where the dielectric factor is constant over the entire length.

As is clear from the foregoing description, according to the modified resonator 2H of the invention wherein the dielectric constant of the both-end open type ½ wave length coaxial TEM resonator is made smaller in the vicinity of the central portion of said resonator than that at the other portions thereof, the spurious mode characteristics of the resonator are also improved, with the frequency of the second higher harmonic resonance being shifted to the higher region where no inconveniences are experienced in the actual use of the resonator.

Needless to say the resonator described as employed in the filters FA, FB, FC and FD in the foregoing embodiments may be replaced by any of the modified resonators 2E, 2F, 2G, 2G' and 2H described with reference to FIGS. 13 to 18 depending on the necessity.

Note that, although the foregoing embodiments have mainly been described with reference to electrical filters employing the both-end open type ½ wave length coaxial TEM resonators, the concept of the present invention is not limited in its application to the electrical filters employing resonators of the above described type, but may be readily applicable to electrical filters employing other types of resonators, for example, ¼ wave length coaxial resonators and the like.

Although the present invention has been fully described by way of example with reference to the attached drawings, note that various changes and modifications are apparent to those skilled in the art. Therefore, unless these changes and modifications depart from the scope of the present invention, they should be construed as included therein.

What is claimed is:

1. An electrical filter comprising:

an electrically conductive housing means having at least one cylindrical bore therein;

at least one resonator means disposed in said at least one bore of said housing means, said resonator means including a cylindrical dielectric member having a coaxial bore therein, an outer conductor member disposed on the outer periphery of said dielectric member and electrically connected to said housing means, and an inner conductor member disposed on the periphery of said coaxial bore of said dielectric member;

an input means for applying electrical signals to said electrical filter;

an output means for removing electrical signals from said electrical filter; and a coupling means for electrically coupling said input means, said resonator means and said output means in series.

2. An electrical filter as claimed in claim 1, wherein each of said resonator means comprises a both-end open type ½ wavelength transverse electro-magnetic mode coaxial resonator.

3. An electrical filter as claimed in claim 1, wherein said dielectric member of said resonator means comprises a ceramic dielectric material of the titanium oxide group.

4. An electrical filter as claimed in claim 1, wherein the ratio of the inner diameter of said outer conductor member divided by the external diameter of said inner conductor member is approximately 3.6.

5. An electrical filter as claimed in claim 1, wherein said dielectric member is composed of a plurality of dielectric pieces each having a central opening formed therein to form said dielectric member when combined with each other.

6. An electrical filter as claimed in claim 1, wherein said resonator means further comprises a variable capacitor means connected between said inner conductor member and said outer conductor member through said dielectric member in a position adjacent to one end of said resonator means.

7. An electrical filter as claimed in claim 1, wherein said outer conductor member of each of said resonator means has annular junction terminal portion integrally formed therewith so as to be disposed at least alone one end face of said dielectric member for connection of said annular junction terminal portion with the inner surface of said bore wherein said means is disposed by soldering, the width of said annular junction terminal portion being approximately half of the difference between the external diameter of said dielectric member and the internal diameter of said dielectric member multiplied by 0.2.

8. An electrical filter as claimed in claim 1, wherein each of said resonator means has an opening formed in said dielectric member between said outer conductor and said inner conductor in a position in the vicinity of the central portion of said resonator means and further comprises an electrically conducting member accomodated in said opening.

9. An electrical filter as claimed in claim 1, wherein each of said resonator means further comprises an electrically conductive member extending through said dielectric member between said inner conductor member and said outer conductor member in a position in the vicinity of the central portion of said resonator means for electrically connecting said inner conductor member and said outer conductor member.

10. An electrical filter as claimed in claim 1, wherein said at least one bore comprises a plurality of bores, one resonator is disposed in each bore and said coupling means includes coupling capacitors having electrodes disposed at the ends of said inner conductor members of each of said resonator means, and wire conductor members for connecting respective coupling capacitors of said resonator means in series to each other and for connecting the coupling capacitor at one end of the first of said resonator means to said input means and the coupling capacitor at the other end of the last of said resonator means to said output means.

11. An electrical filter as claimed in claim 1, wherein said inner conductor member comprises a metal superior in high frequency electrical conductivity applied to the periphery of said coaxial bore by an electrode forming method and wherein said outer conductor member comprises a metal superior in high frequency electrical conductivity applied to the outer periphery of said dielectric member by an electrode forming method.

12. An electrical filter as claimed in claim 11, wherein said metal is silver and said electrode forming method includes baking.

13. An electrical filter as claimed in claim 1, further comprising an inner conductor electrode for said inner conductor member of a metal superior in hgih frequency electrical conductivity applied to the periphery of said coaxial bore by an electrode forming method, and an outer conductor electrode for said outer conductor member of a metal superior in high frequency electrical conductivity applied to the outer periphery of said dielectric member by an electrode forming method having an annular junction terminal portion integrally and concentrically formed therewith disposed along at least one end face of said dielectric member for connection with said outer conductor member.

14. An electrical filter as claimed in claim 13, wherein the width of said annular junction terminal portion is approximately half of the difference between the external diameter of the dielectric member and the internal diameter of the dielectric member multiplied by 0.2.

15. An electrical filter as claimed in claim 1, wherein said housing means is a hollow cylindrical tube.

16. An electrical filter as claimed in claim 15, wherein said outer conductor member of each of said resonator means has an annular junction terminal portion integrally formed therewith so as to be disposed at least along one end face of said dielectric member for connection of said annular junction terminal portion with the inner surface of said hollow cylindrical tube by soldering, the width of said annular junction terminal portion being approximately half of the difference between the external diameter of said dielectric member and the internal diameter of said dielectric member multiplied by 0.2.

17. An electrical filter as claimed in claim 1, wheren said housing means is a casing member of rectangular cubic configuration having a plurality of bores formed therein.

18. An electrical filter as claimed in claim 17, wherein said casing member is a solid structure and said plurality of bores are longitudinally formed in said housing member in parallel relation to each other.

19. An electrical filter as claimed in claim 17, wherein said casing member is a hollow structure, said plurality of bores are defined by a plurality of hollow cylindrical tubes longitudainlly secured in said casing in parallel realtion to each other, said hollow cylindrical tubes forming said outer conductor members for said resonator means disposed in said bore thereby defined, further comprising cut-off waveguide means formed at opposite ends of said resonator means within said hollow cylindrical tubes.

20. An electrical filter as claimed in claim 19, wherein said coupling means includes shielding plate member disposed between respective resonator means, and capacitor means extending through said shielding plate member, said capacitor means being connected at opposite ends thereof to end portions of said inner conductor member of said resonator means, with said input and output connector means being connected to said resonator means through another capacitor means for coupling the resonator means with respect to electric field thereof.

21. An electric filter as claimed in claim 19 wherein one resonator means is disposed in each bore and said coupling means comprises an input exciter line connected to said input means and the outer periphery of said dielectric member of a first of said series-connected resonator means, an output exciter line connected to said output means and the outer periphery of said dielectric member of the last of said series-connected resonator means and wherein said hollow cylindrical tubes have openings disposed therein at positions where said resonator means are opposite one another for magnetic coupling therebetween.

22. An electrical filter as claimed in claim 1, wherein said dielectric member of said resonator means has a dielectric constant at the central portion thereof which is smaller than the dielectric constant at other portions thereof.

23. An electrical filter as claimed in claim 22, wherein said dielectric member comprises three pieces each having a central opening to form said coaxial bore of said dielectric member when bonded to each other, the central piece of said three pieces having a dielectric constant smaller than the dielectric constant of the other two pieces located at opposite ends of said dielectric member, said coaxial bore and the outer periphery of said dielectric member being coated with metal superior in high frequency electrical conductivity at respective surfaces thereof to form said inner conductor member and said outer conductor members, said coaxial bore being further filled with ceramic material for reinforcement of said dielectric member.

24. An electrical filter as claimed in claim 1, wherein said inner conductor member comprises a cylindrical metallic tube having an axial slot for insertion of said inner conductor member into said coaxial bore and securing thereto through the elasticity of said metallic tube, further comprising an outer electrode for said outer conductor member of a metal superior in high frequency electrical conductivity applied to the outer periphery of said dielectric member by an electrode forming method having an annular junction terminal portion integrally and concentrically formed therewith disposed along at least one end face of said dielectric member for connection with said outer conductor member.

25. An electrical filter as claimed in claim 1, wherein said at least one resonator means disposed in said at least one bore comprises a plurality of resonator means disposed in said at least one bore and said coupling means comprises coupling capacitors having electrodes disposed at the ends of said inner conductor member of each of said resonator means, said resonator means being connected through said coupling capacitors, an input wire conductor connected to one coupling capacitor at one end of a first of said series-connected resonator means and to said input means and an output wire conductor connected to one coupling capacitor at the other end of the last of said series-connected resonator means an to said output means.

* * * * *